United States Patent [19]

Williams

[11] 4,392,460

[45] Jul. 12, 1983

[54] PARALLEL INHERENTLY BALANCED ROTARY VALVE INTERNAL COMBUSTION ENGINE

[76] Inventor: Thomas V. Williams, 415 Dreshertown Rd., Fort Washington, Pa. 19034

[21] Appl. No.: 132,606

[22] Filed: Mar. 21, 1980

[51] Int. Cl.[3] ..... F01L 7/00

[52] U.S. Cl. ..... 123/80 BB; 123/41.4; 123/56 AA; 123/190 BA; 123/198 F

[58] Field of Search ..... 123/52 A, 54 R, 54 A, 123/56 A, 56 AA, 56 B, 56 BA, 41.40, 51 R, 51 BA, 51 AA, 197 R, 80 R, 80 BB, 190 B, 190 BA, 296, 198 F

[56] References Cited

U.S. PATENT DOCUMENTS

| | | | |
|---|---|---|---|
| 1,305,728 | 6/1919 | McCollum | 123/41.4 |
| 1,364,065 | 1/1921 | Asbury | 123/190 BA |
| 1,720,206 | 7/1929 | Carlson | 123/41.4 |
| 2,004,912 | 6/1935 | Heinel | 123/190 BA |
| 2,018,975 | 10/1935 | Schutzniedrig | 123/56 A |
| 2,156,202 | 4/1939 | Spencer | 123/56 AA |
| 3,043,283 | 7/1962 | Vitale | 123/56 A |

FOREIGN PATENT DOCUMENTS

| | | | |
|---|---|---|---|
| 498317 | 5/1930 | Fed. Rep. of Germany | 123/190 BA |
| 719619 | 4/1942 | Fed. Rep. of Germany | 123/190 BA |
| 1389383 | 4/1975 | United Kingdom | 123/296 |

*Primary Examiner*—Craig R. Feinberg
*Assistant Examiner*—W. R. Wolfe
*Attorney, Agent, or Firm*—Karl L. Spivak

[57] ABSTRACT

An internal combustion engine having banks of oppositely disposed cylinders is disclosed having a rotary valve for each bank which directs the flow to supply the inlet air and to dispose to the exhaust gases. Each of the rotary valves can be liquid cooled and is synchronized to time the inlet and exhaust gas to and from the proper cylinders. A fuel injection system provides the fuel to stratify its change. The fuel supply to any cylinder can be controlled or terminated during the low power requirement of the engine, such as when the engine is operating at reduced power or when the engine is idling. The engine can be built in any number of cylinders, but the four and eight cylinder combination makes for the most compact design.

13 Claims, 10 Drawing Figures

78
86
62
72
80
80
73
74
76
5
84
101
5
71
70
73
52
52
82
50
50
68
8
75
66
60
PISTON
16
75
8
97
60
66
64
62
52
50
88
92
90
32
98

PARALLEL INHERENTLY BALANCED ROTARY VALVE INTERNAL COMBUSTION ENGINE

BACKGROUND

The eight cylinder inherently balanced internal combustion engine is per se old as disclosed in my U.S. Pat. No. 3,581,628. The present invention is an improvement on the engine disclosed in said patent. In said patent, the cylinders are disposed in side-by-side relationship. In the present invention, the cylinders are arranged in two banks opposite one another and are disposed to reduce engine unbalance. The cylinders can preferably be arranged horizontally.

One of the problems inherent in the prior art internal combustion engines is the large number of components such as valves, camshafts, push rods, etc. which must operate in a synchronized manner. The present invention eliminates a large number of these conventional components such as the camshaft, carburetor, rocker arms, tappets, poppet valves, springs, and reduces the number of valves from sixteen poppet type valves to two rotary valves for an eight cylinder engine.

SUMMARY OF THE INVENTION

The present invention is directed to an internal combustion engine containing a plurality of cylinders each containing a piston in conventional arrangement therein. A combined supply and exhaust valve (herein designated a rotary valve) is disposed between and adjacent to the cylinders for rotation about an axis which is parallel to and equally spaced from the center of each group of four cylinders. The valve includes a rotary valve member which is supported by journal bearings, one near the drive end of the engine and the other near the intake and exhaust openings or parts from the cylinders to the valve. The rotary valve member has a fuel-air inlet passage or part which aligns with the cylinder head of one cylinder during the intake stroke thereof for feeding fuel and air thereto while the coaxially disposed exhaust passage in the valve member communicates with another cylinder to discharge the exhaust. The valve member is provided with an air, oil or other liquid coolant rotary to provide cooling between said fuel-air inlet passage and said exhaust passage so the coolant may flow through the chamber and cool same. The rotary valve could also be made from a high temperature ceramic which would not require cooling. A fuel injector communicates with the air and fuel inlet passage to or in the valve member and supplies fuel in synchronism with the rotation of said valve member and as required by the said cylinder.

Due to the balancing out of secondary harmonics, and other factors as will be made clear hereinafter, the present invention reduces the lateral vibrations normally associated with many commercially available internal combustion engines. While stratified charges per se are known, the present invention utilizes a rotary valve member as a supply delivery source and the mixing chamber for a stratified charge to obtain a better mix and thereby lower pollutants and improve combustion.

The rotary valve revolves at one-half engine speed for a four cycle engine on a center line that is parallel with the center line of the four cylinders which are equally spaced (90 degrees apart) with respect to the rotary valve. Each valve feeds four cylinders sequentially and consecutively at the intake port of each cylinder and simultaneously accepts the exhaust from one of the cylinders sequentially and consecutively as provided by the ports in the rotary valve.

The feed of the intake and acceptance of the exhaust is through a port opening at both the cylinder and at the rotary valve. The cylinder port opening is used for both intake and exhaust to each cylinder. The rotary valve has two approximate radial openings, one is the intake which can feed air/fuel mixture from the center of one end of the valve to the port opening of one cylinder, while the other radial opening accepts the exhaust gases from a second cylinder port opening into the center of the valve and out.

In the preferred embodiment of a four cylinder engine, there would be one-half of the cylinders that are in the eight cylinder engine listed below. In the preferred embodiment of an eight cylinder engine, there are two banks of cylinders oppositely disposed and adjacently arranged. The pistons of two cylinders of each bank are connected to a common crankshaft. There are two crankshafts disposed besides each other and together. Each bank of synchronized cylinders includes a rotary valve to supply the air and fuel and to dispose of the exhaust. Each rotary valve is synchronized with a fuel injector or supply source. For low power requirements such as idling, coasting, etc., a supply of fuel to one of the rotary valves is cut off to thereby improve the engine's fuel consumption and reduce the pollutants.

It is an objective of the present invention to provide a novel internal combustion engine which is balanced with respect to primary and secondary forces for the eight cylinder model, uses less parts, and has lower vibration and better efficiency. There is better overall volumetric efficiency because of the continuous flow of air and gas mixture from the valve into the cylinder chamber rather than the intermittent flow with a poppet valve type engines. Also, by the use of valve port opening overlap (the opening on the valve is larger radially than the passage going into each cylinder), the valve has full opening for a predetermined time or a variable length of time because of the mechanism which can vary the timing of the valve while the engine is running the rotary valve is shown somewhat as a cylinder, but it can be made of any shape required to accommodate the cylinder opening.

Other objectives and advantages will appear hereinafter.

For the purpose of illustrating the invention, there is shown in the drawings a form which is presently preferred; it being understood, however, that this invention is not limited to the precise arrangements and instrumentalities shown.

FIG. 5A is a diagrammatic plan view of a rotary valve which has rotated 45 degrees clockwise from the position in FIG. 5 to a point where cylinder 54 is ready for firing.

Figure 1:
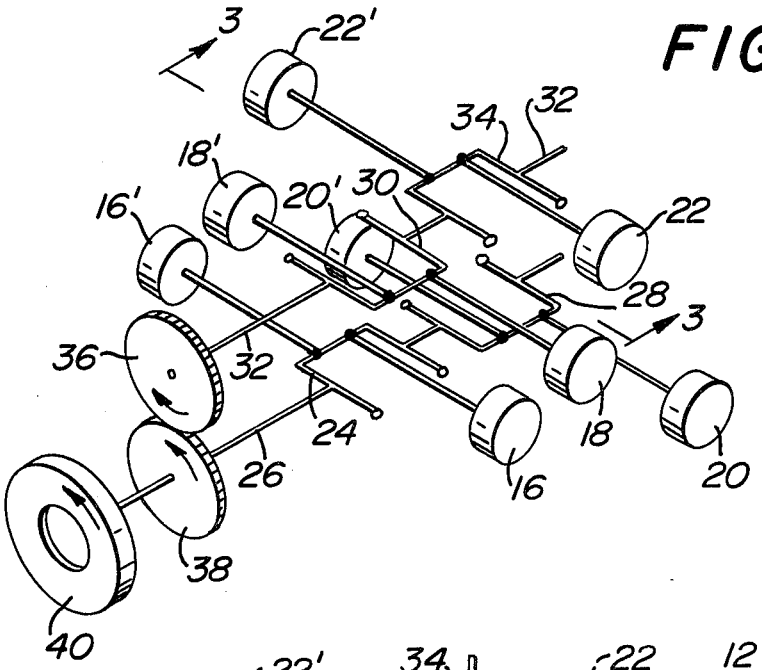
FIG. 1 is a diagrammatic illustration of the arrangement of the crankshafts and pistons for an eight cylinder engine.
Figure 2:
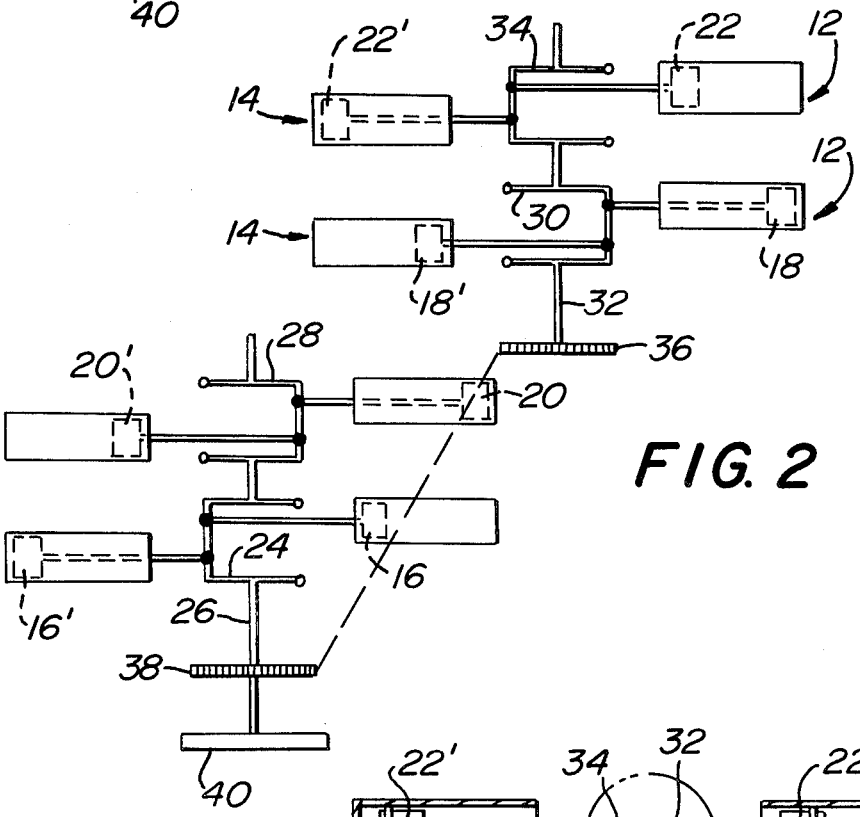
FIG. 2 is a diagrammatic exploded plan view of the arrangement shown in FIG. 1.
Figure 3:
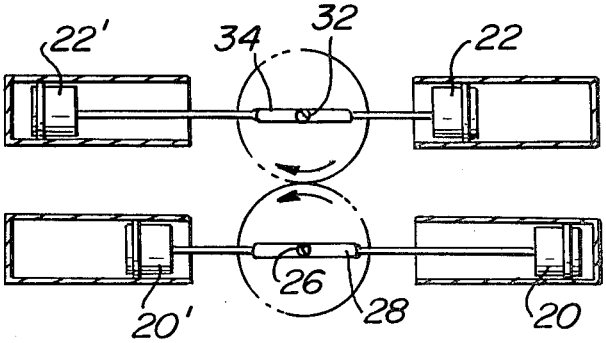
FIG. 3 is a sectional view taken along the line 3—3 in FIG. 1.
Figure 2A:
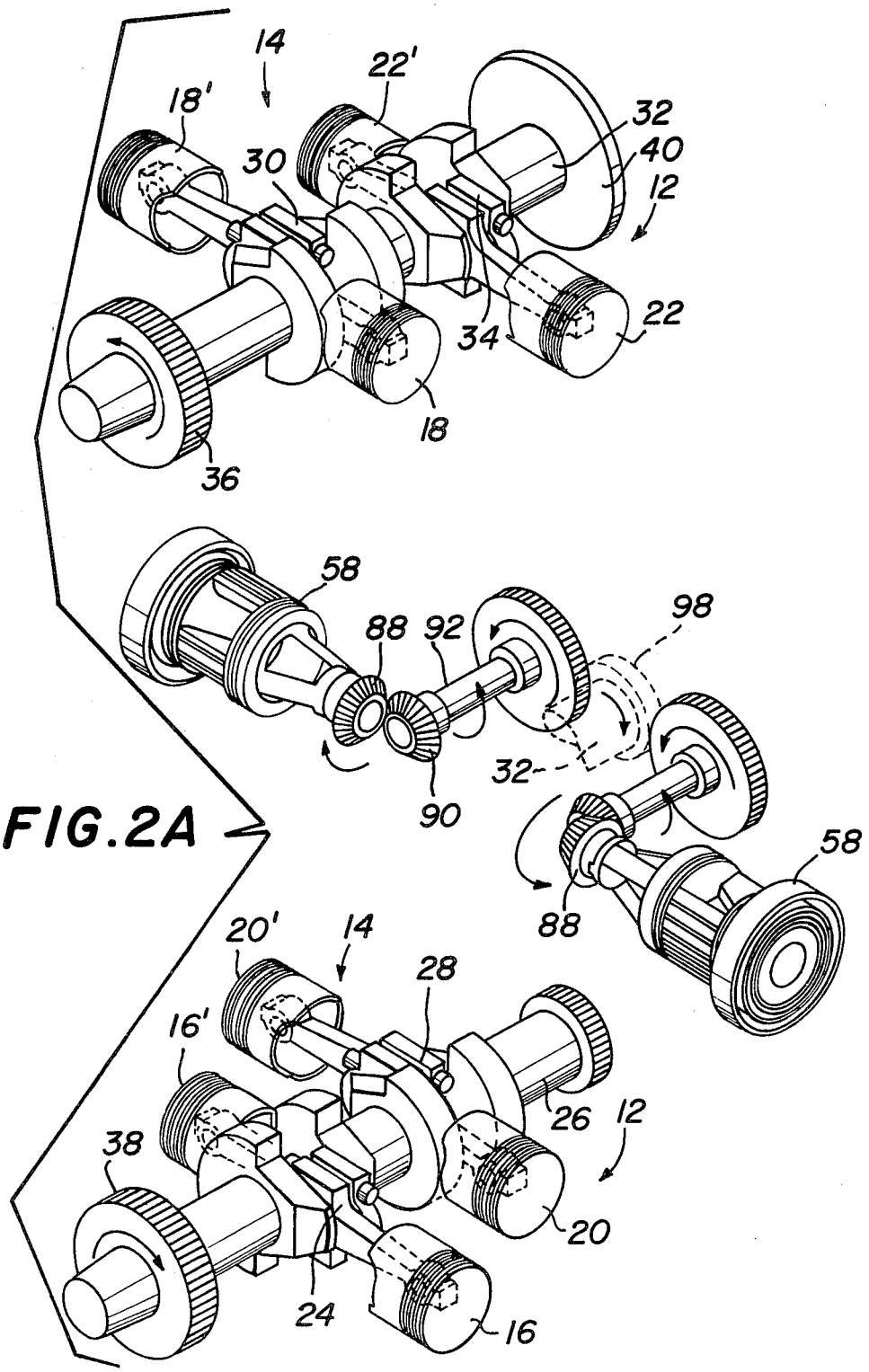
Figure 4:
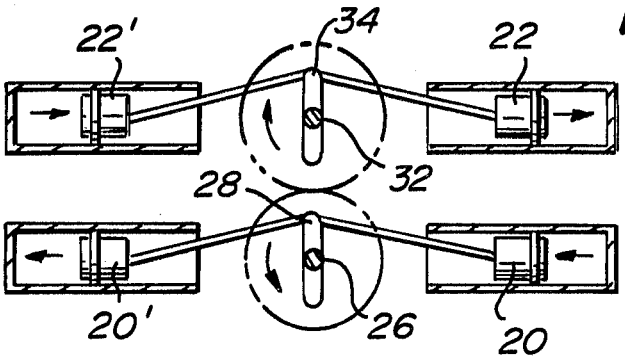
FIG. 4 is a sectional view taken along the line 3—3 in FIG. 1 when the crankshafts have turned 90 degrees.
Figure 6:
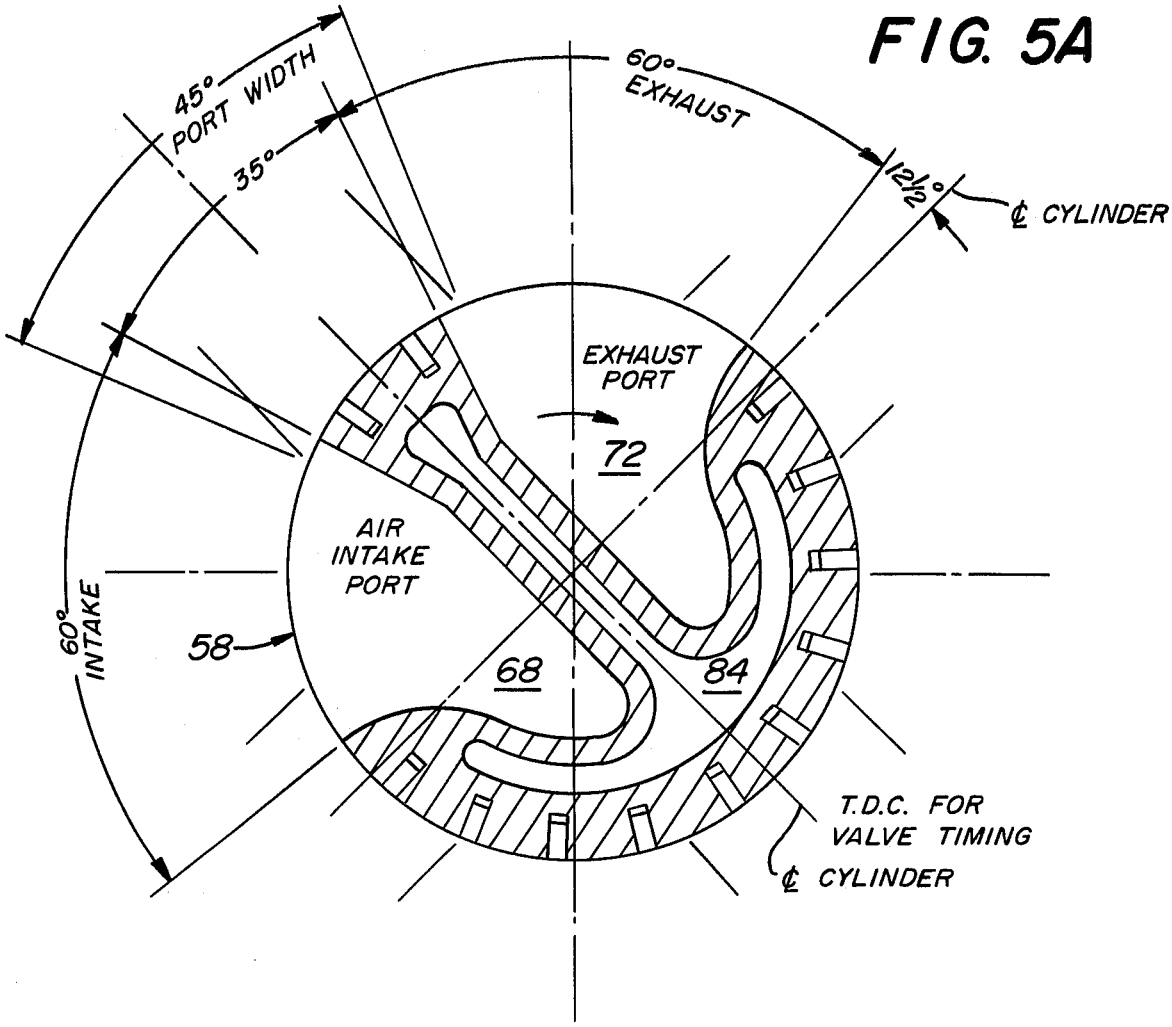
FIG. 6 is a top plan view of the engine in accordance with the present invention.
Figure 6:
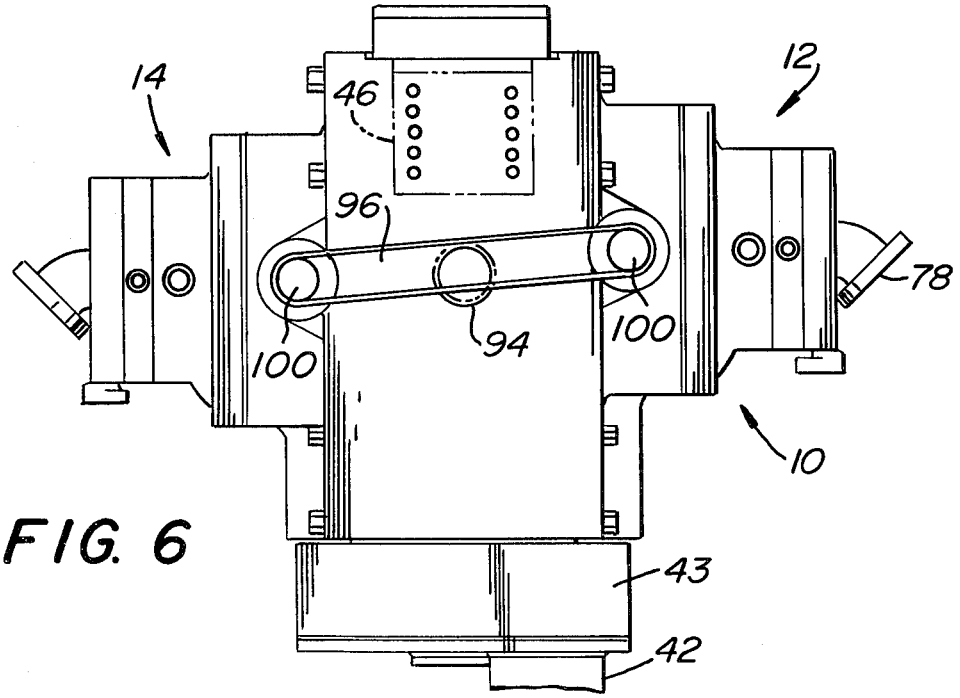

Referring to the drawings in detail, wherein like numerals indicate like elements, there is shown in FIG. 1 a diagrammatic arrangement of the crankshafts and pistons of the engine 10 of the present invention. Referring initially to FIG. 6, the engine 10 includes a first bank of cylinders 12 on one side and a second bank of cylinders 14 on the opposite side. The cylinders are horizontally disposed. Referring again to FIG. 1, the bank 12 includes cylinders for the pistons 16, 18, 20 and 22. The bank 14 includes cylinders for the pistons 16', 18', 20', and 22'.

The pistons 16 and 16' are connected by a connecting rod to a common crank 24 on a lower crankshaft 26. Hence, the pistons 16 and 16' will be 180 degrees out of phase. The crank 24 has an extension with balancing weights. Pistons 20 and 20' are similarly connected to a crank 28 on the crankshaft 26 so as to be 180 degrees out of phase. The cranks 24 and 28 are 180 degrees out of phase. Crank 28 is similarly balanced.

The pistons 18 and 18' are connected to a common crank 30 on the upper crankshaft 32. Pistons 18 and 18' are 180 degrees out of phase. Crank 30 is in phase with crank 28. Hence, pistons 18 and 20 are in phase and pistons 18' and 20' are in phase. Pistons 22 and 22' are connected to a common crank 34 on the upper crankshaft 32. Pistons 20 and 22 are 180 degrees out of phase. Crank 34 is 180 degrees out of phase with crank 30 and each of the cranks are similarly balanced.

The crankshaft 26 and the crankshaft 32 rotate in opposite directions. A gear 36 on crankshaft 32 meshes with gear 38 on crankshaft 26. A flywheel 40 is connected to shaft 26. However, the flywheel could be connected to shaft 32 instead or the engine could be turned over.

Figure 7:
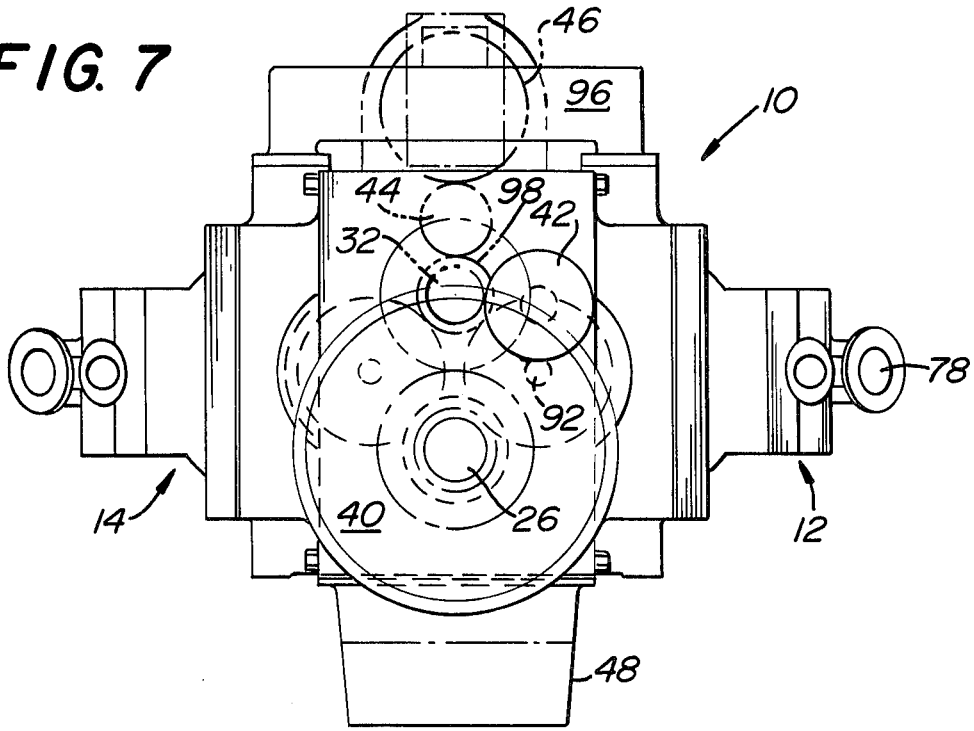
FIG. 7 is an elevation view of the engine in accordance with the present invention.

Referring to FIGS. 6 and 7, a starter motor 42 is coupled to the starter flywheel 40 and is supported by the housing 43 for the flywheel 40. Referring to FIG. 7, the upper crankshaft 32 is coupled by way of gear 44 to the fuel injector pump drive 46 which may be a conventional eight cylinder fuel injector pump such as Bosche No. RBC-EP2248 or it can be two four cylinder fuel injector pumps side by side. The housing of engine 10 has oil pan 48 on the lower end thereof as shown in FIG. 7.

Figure 5:
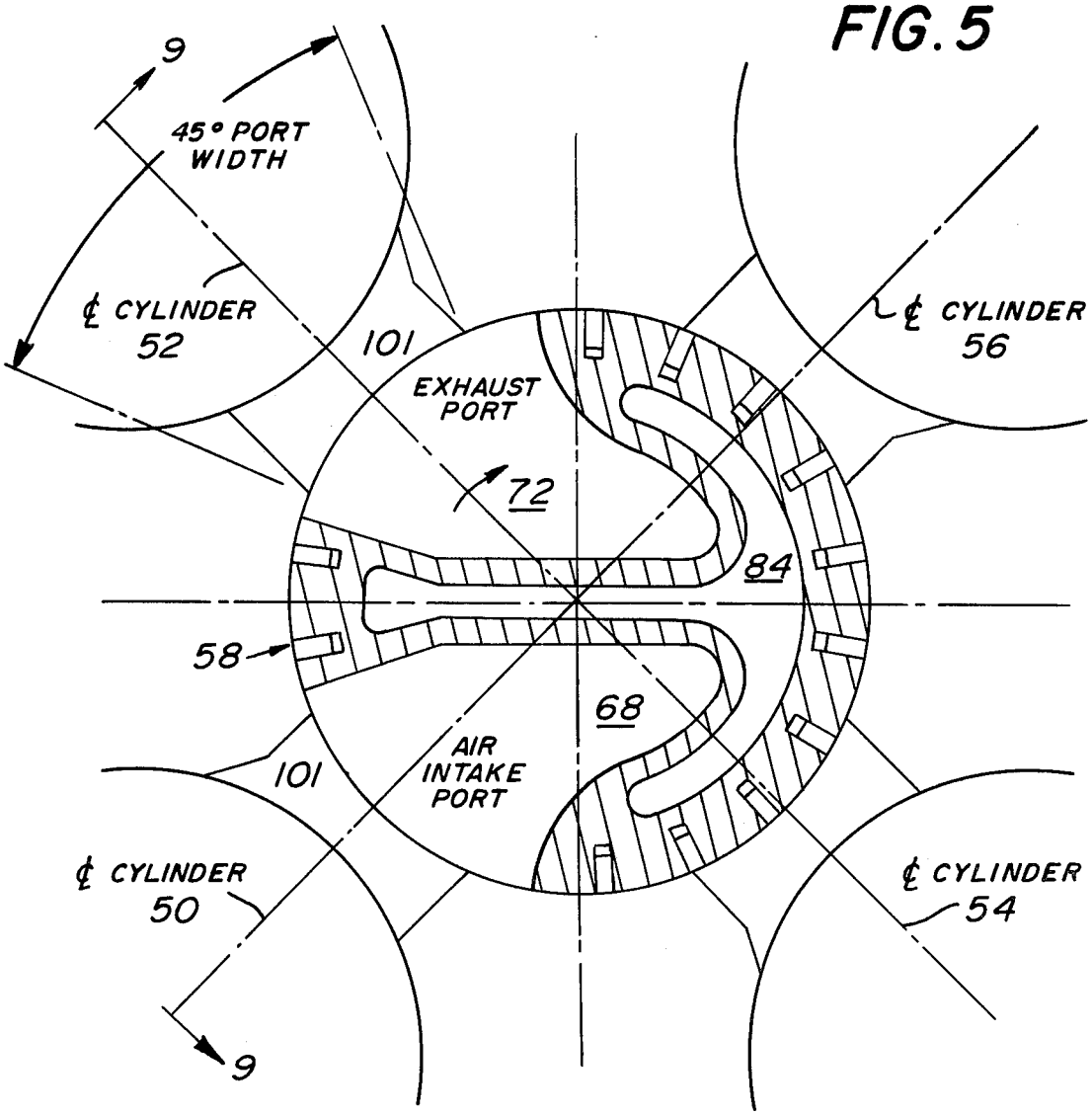
FIG. 5 is a diagrammatic plan view along the line 5—5 in FIG. 9 of a rotary valve with the exhaust and intake ports at full opening.
Figure 8:
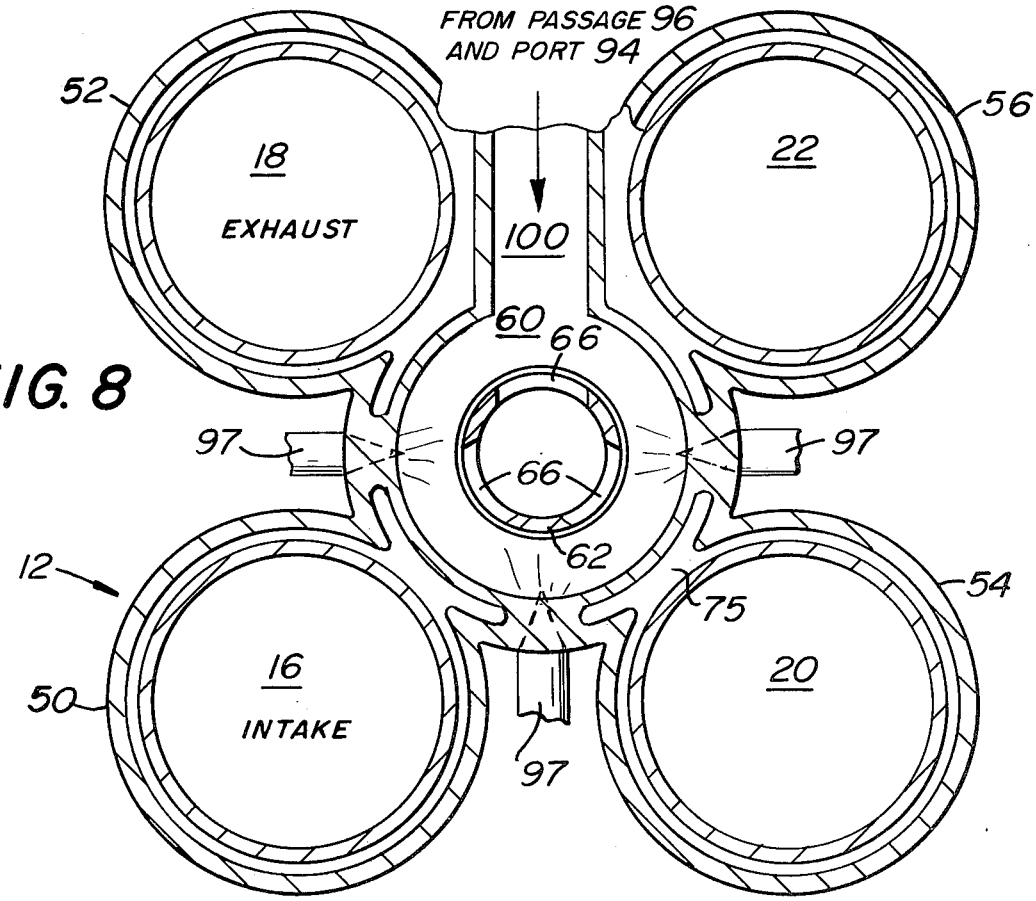
FIG. 8 is a sectional view taken along the line 8—8 in FIG. 9.

The banks of cylinders 12 and 14 are identical but of opposite hand. The engine could be made as a one bank engine of four cylinders with one rotary valve. The rotary valves turn in opposite directions (or in the same direction) in relation to each other but when viewed from each of the cylinder heads into the center of the engine, the valves turn in the same direction. Accordingly, only bank 12 will be described in detail. As shown in FIG. 8, the bank 12 includes an upper pair of cylinders 52, 56 and a lower pair of cylinders 50, 54. Cylinder 52 contains piston 18, cylinder 56 contains piston 22, cylinder 50 contains piston 16 and cylinder 54 contains piston 20. A rotary supply and exhaust valve 58 is provided between the cylinders 50–56 as shown in FIG. 5. The valve 58 in FIGS. 5 and 5A includes a horizontally disposed rotary valve member 62 having inlet ports 66 at its inner end (see FIG. 9) which communicate as it rotates within the surrounding inlet passage 60. Referring to FIG. 8 and the lower end of FIG. 9, there is provided a fuel-air inlet passage 68 which receives air from a filtered air inlet passage 60 and receives fuel from pump 46 via injectors 97. Fuel inlet injectors 97, in FIGS. 8 and 9, extend radially from the axis of valve member 62. One injector 97 is needed for each bank for engines running up to 5,000 rpm. Two injectors 97 are needed for each bank with engines running up to 10,000 rpm. Three injectors 97 are needed for each bank with engines running at 15,000 rpm.

Figure 9:
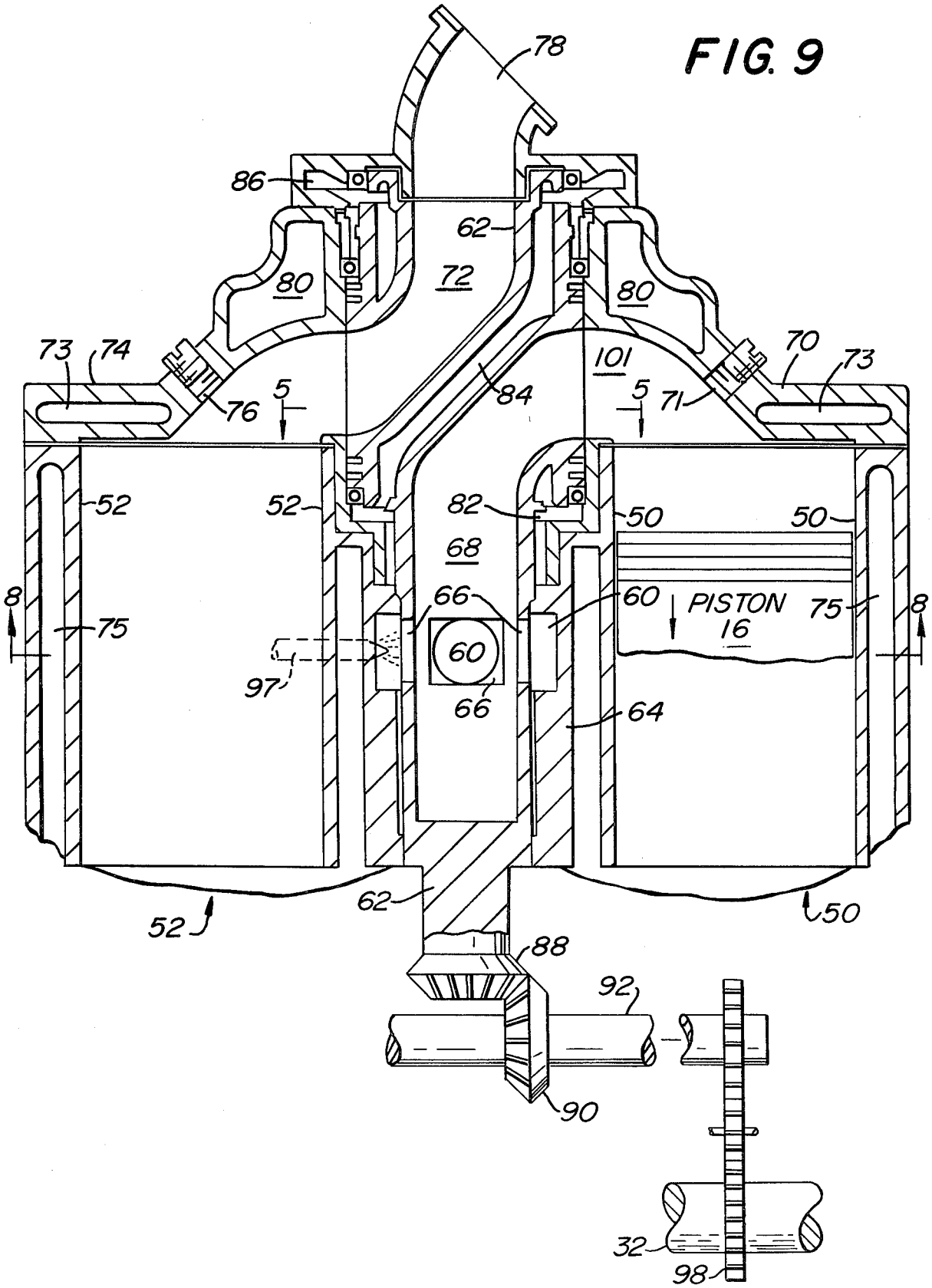
FIG. 9 is a sectional view taken along the lines 9—9 in FIG. 5.

The outer end of fuel air passage 68 in FIG. 9 communicates with the part in the cylinder head 70 for the cylinder 50. Cylinder head 70 includes a hole 71 for receiving a spark plug or spray nozzle not shown. A spark plug is not needed for high compression (compression ignition) diesel engines. Also, with a diesel engine the fuel injection spray nozzle could inject the fuel directly into each cylinder through the hole 71 where the spark plug would be installed in a spark ignition engine. The valve member 62 also includes an exhaust passage 72 which provides communication between the part of the cylinder head 74 and the exhaust outlet 78. Thus, in the arrangement as illustrated in FIGS. 5, 8 and 9, an air and fuel mixture is being supplied to cylinder 50 while cylinder 52 is being exhausted after the power stroke. The cylinder head 74 is similarly provided with a hole 76 for receiving a spark plug not shown, but this hole can be used for a fuel injector for a diesel engine configuration.

In order to prevent the heat of the exhaust gases in passage 72 in FIG. 5, 5A and 9 from preigniting a fuel mixture in passage 68, the valve member 62 is cooled by coolant in passage 84. Valve member 62 can be cooled by other high temperature resistant fluids. The oil pump supplies oil or other liquid coolant from the pan 48 in FIG. 7 to chamber 86 which surrounds the outer end of valve member 62 as shown in FIG. 9. From chamber 86 by way of passage in the valve member 62, cooling oil flows through chamber 84 to chamber 82 which communicates with the oil pan 48. This straight through pass could be reversed at the inner end and pass out the outer end of the valve in another configuration or could loop down and up, discharging at the same end as the inlet. Each of the cylinder heads 70, 74 in FIG. 9 can be part of one casting and may have a water coolant passages 73 and 80. Likewise, each of the four cylinders, such as cylinders 50 and 52 in FIG. 9, have a water or other coolant passage 75 which connects to passage 73 and 80 and then goes back to a radiator for cooling.

The inner end of valve member 62 for bank 12 is closest to the crankshaft drive of the engine 10 and is provided with a bevel gear 88. Gear 88 meshes with bevel gear 90 on valve timing shaft 92. A similar timing shaft is provided for the valve of bank 14. Each of the timing shafts has gears synchronized with gear 98 on crankshaft 32 as shown in FIG. 9 so that the rotation of each rotary valve 58 will be synchronized with the fuel injector pump 46. The fuel will be injected into the air passage 60 by injectors 97 in FIGS. 8 and 9 as soon as passage 68 is in communication with a cylinder such as the cylinder 50 in FIGS. 5 and 9 and during the length of time of such communication as the valve member 62 which is a part of valve 58 continuously rotates about its longitudinal axis. Since there is no carburetor in this embodiment, but the engine could be so equipped, air flows from port 94 through 96 into manifold 100 (FIG.

6) and flows into annulus 60. The fuel from one of the injectors 97 in FIGS. 8 and 9 is timed so that it will mix in a stratified manner and then is sprayed and mixed with air as it flows from annulus 60. The fuel from one of the injectors 97 in FIGS. 8 and 9 is mixed with air as it flows from annulus 60 through turbine-like radial rectangular slots 66 in rotary valve 58 in a swirling mixing motion along the center line of the valve tube 68 and then through cylinder port 101 (FIG. 5) into cylinder 50. When the intake port in passage 68 starts to open for cylinder 50, pure air comes from tube 100 and around the annulus through the port 66 and up through the valve passage 68 and from there into cylinder 50 in a swirling motion above piston 16 which is moving down. Injector 97 is adjustable and is timed to spray fuel into the moving air at the time that piston 16 has moved down to near the bottom of the stroke in order to stratify the fuel. When rotary valve 58 cuts off passage 68 from cylinder 50, all of the fuel that was sprayed from injector 97 will have completely passed through the valve passage 68 and completely through the cylinder into the cylinder port opening 101. The air fuel mixture flows into the cylinder in a swirling motion. Since the injector 97 is opened and fuel is mixed with air only when the cylinder is almost filled, the fuel/air mixture will remain near the cylinder head port area and spark plug as a stratified charge. When piston 16 which can be contoured to help stratify the charge has gone through its compression stroke, it will facilitate starting combustion in the densest part of the stratified charge. The engine speed and power will be controlled by varying the amount of fuel that is injected by the injector 97.

The drive end of the engine 10 is the end shown in FIG. 7. The water pump and fan are to be connected to the front end of the engine; namely, the end of the engine as shown at the upper end of FIG. 6. Air is fed through the air inlet port 94 and manifold passage 96 to each of the rotary valves. However, a separate intake air port could be used for each bank so that one fuel injection pump could be cut off while the other is operating.

The eight cylinder engine is made up of two opposite banks of cylinders which can have separate intake and exhaust systems. One bank of cylinders can run as a spark ignition gasoline, gasohol, LP gas hydrogen, kerosene or oil engine while the second and opposite bank can be run as a diesel or duel fuel compression type ignition engine.

The spark ignition bank of the engine can be used to start up the diesel bank especially during extra cold weather so that the diesel bank can be run at a considerably lower compression ratio than required for cold starting a decided advantage for lowering the emission as well as lower fuel consumption and better fuel mileage than the spark ignition bank of the engine. The spark ignition bank can be used only for start-up, acceleration and hard pulling. Its power is not needed at times such as idling, coasting, low speed light load operation, etc.

The present invention may be embodied in other specific forms without departing from the spirit or essential attributes thereof and, accordingly, reference should be made to the appended claims, rather than to the foregoing specification, as indicating the scope of the invention.

I claim:

1. An internal combustion engine comprising a first plurality of cylinders, each cylinder comprising a head, a piston, an inlet port and an exhaust port;

a second plurality of cylinders, each cylinder comprising a head, a piston, an inlet port and an exhaust port;

a first rotary fuel valve adjacent to said first plurality of cylinders and a second rotary valve adjacent to the said second plurality of cylinders, each valve having a valve member mounted for rotation about an axis parallel to its adjacent cylinders for feeding a fuel-air mixture to each said cylinder, each valve member having a fuel-air passage terminating in an outlet port for rotating alignment with a cylinder head of one of its adjacent cylinders for feeding a fuel-air mixture into each said cylinder inlet port, each valve member having an exhaust passage terminating in an exhaust inlet port for rotating alignment with a cylinder head of another adjacent cylinder for exhausting gases from the said cylinder exhaust port;

crankshaft means coupled to said pistons for rotation relative to the cylinders, the crankshaft means comprising first and second crankshafts, at least one piston from each of the said first and second pluralities of cylinders being connected to each crankshaft;

a fuel injector means communicating with each fuel-air passage in all rotary positions of each valve member to feed a fuel-air mixture into each fuel-air passage;

drive means for rotating the valve members continuously about their respective longitudinal axes; and gear means connected to rotate simultaneously the first and second rotary valves, the said gear means being adapted to rotate the first and second rotary valves in opposite directions.

2. The internal combustion engine of claim 1 wherein the first and second crankshafts are one hundred and eighty degrees out of phase.

3. The internal combustion engine of claim 1 and means for synchronizing the drive means for the said valve members with the said fuel injector means.

4. The internal combustion engine of claim 1 wherein at least one group of cylinders comprises a compression ignition system for use with a diesel fuel.

5. The internal combustion engine of claim 1 wherein each crankshaft comprises a plurality of cranks and wherein one piston from the first plurality and one piston from the second plurality is connected to a common crank.

6. The internal combustion engine of claim 5 wherein the said piston from said first plurality is connected to be one hundred and eighty degrees out of phase with the said piston from the second plurality.

7. The internal combustion engine of claim 1 wherein the number of cylinders in the second plurality is equal to the number of cylinders in the first plurality.

8. The internal combustion engine of claim 7 wherein the number of cylinders in each plurality is four.

9. The internal combustion engine of claim 1 and means defining a coolant chamber in each valve member for passage of a coolant therethrough.

10. The internal combustion engine of claim 9 wherein the coolant chamber is interposed between the fuel-air passage and the exhaust passage.

11. The internal combustion engine of claim 1 wherein each of said cylinders is generally horizontally disposed.

12. The internal combustion engine of claim 11 wherein each of said rotary valve members is horizontally disposed.

13. The internal combustion engine of claim 12 wherein the axis of rotation of the crankshafts are generally perpendicular to the axis of rotation of the rotary valve members.

* * * * *